United States Patent [19]

Pagelli

[11] Patent Number: 5,012,716

[45] Date of Patent: May 7, 1991

[54] ROTATABLE PICK-UP HEAD FOR ELECTRIC GUITAR

[75] Inventor: Claudio Pagelli, Chur, Switzerland

[73] Assignee: Dronge & Rapoport Inc., Tenafly, N.J.

[21] Appl. No.: 326,521

[22] Filed: Mar. 21, 1989

[51] Int. Cl.[5] ..... G10H 3/18

[52] U.S. Cl. ..... 84/727; 84/743

[58] Field of Search ..... 84/723, 725–729, 84/743

[56] References Cited

U.S. PATENT DOCUMENTS

| | | | |
|---|---|---|---|
| 3,725,561 | 4/1973 | Paul | 84/726 |
| 3,780,202 | 12/1973 | Law | 84/726 |
| 3,869,952 | 3/1975 | Rowe | 84/727 |
| 4,394,830 | 7/1983 | Damiano | 84/726 |
| 4,501,186 | 2/1985 | Ikuma | 84/726 |
| 4,632,003 | 12/1986 | Kopp | 84/723 |

*Primary Examiner*—Stanley J. Witkowski

*Attorney, Agent, or Firm*—Robert S. Beiser

[57] ABSTRACT

An electrical guitar is provided having a conventional guitar body, strings and mounting bridge for the strings. A manually rotatable disc is rotatably mounted on the guitar. On the rotatable disc are one or more electromagnetic pick-up heads which allow the pick-up heads to be rotated to a number of desired positions. The rotatable disc may be selectively fixed on each position by a brake or by friction. The pick-up heads are constructed to remain electrically connected to an amplifier during rotation. In addition, the rotatable disc is sized and positioned to facilitate easy, manual rotation thereof during performance by the musician.

16 Claims, 4 Drawing Sheets

Fig. 5
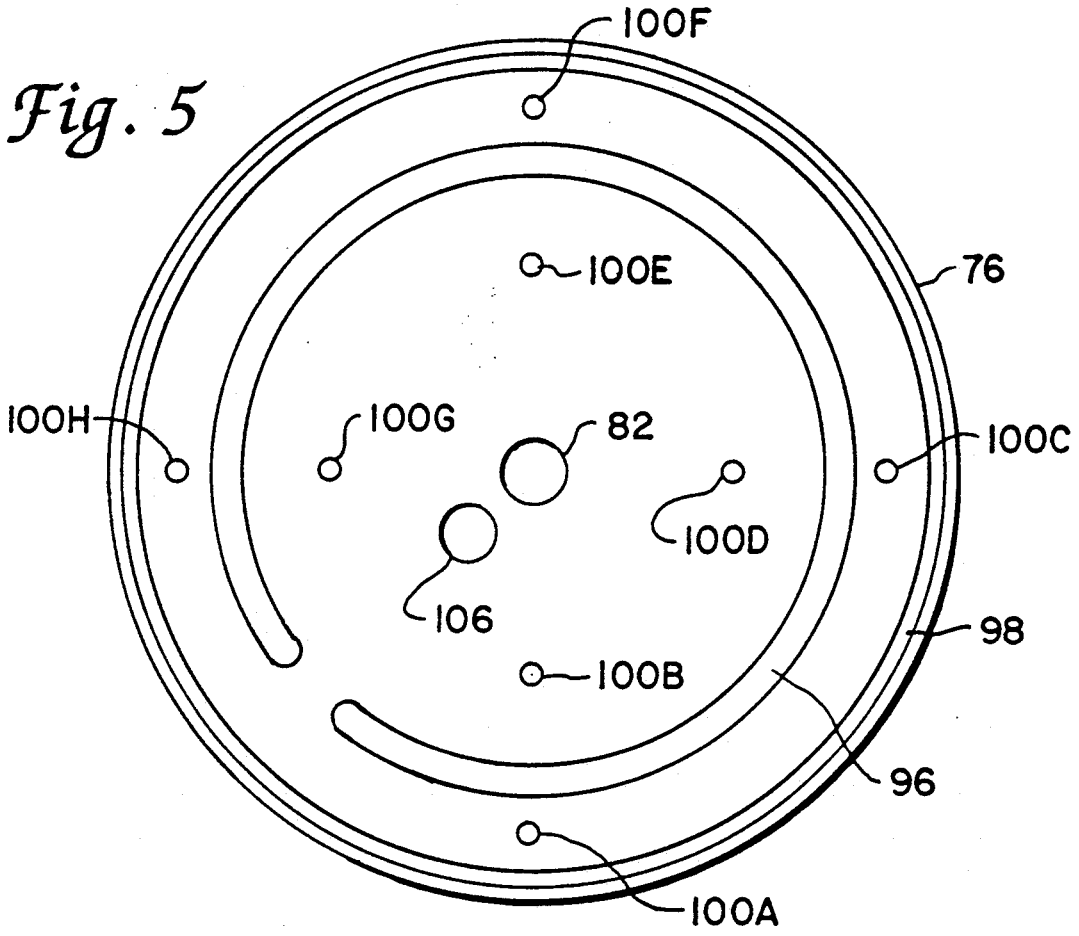
Fig. 6
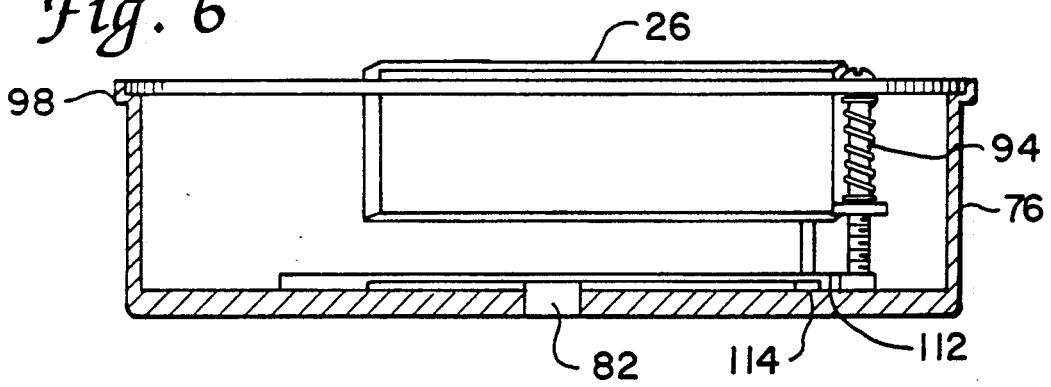
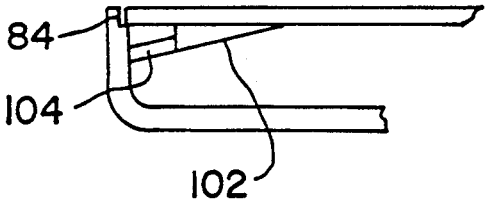
Fig. 7

ROTATABLE PICK-UP HEAD FOR ELECTRIC GUITAR

BACKGROUND OF THE INVENTION

1. Field of the Invention

This invention relates to musical instruments in general and in particular to an electric guitar having a rotatable pick up head.

2. Prior Art

It has been known in the past to mount a pick-up on a guitar in such a manner that its location can be altered. Examples include U.S. Pat. No. 4,261,240, Aaroe, in which an electromagnetic transducer may be oscillated in order to emit a tremolo from a guitar. Similarly, U.S. Pat. No. 3,911,777, Rendell, discloses a electric guitar having a slidable pick-up head. However, the position of the pick-up head in the '777 patent may only be adjusted longitudinally. Similarly, the position of the pick-up head in the '240 patent may only be mechanically oscillated at variable frequencies.

SUMMARY OF THE INVENTION

Accordingly, it is an object of the present invention to overcome the disadvantages, deficiencies and problems referred above as existing in the prior art.

Another object of the present invention is to provide a new and improved means for rotatably mounting an electric pick-up.

A further object of the present invention is to provide means for movably mounting an electric pick-up within the body of an electric guitar, if desired.

Many other advantages, features and other additional objects of the present invention will become manifest to those versed in the art upon making reference to the detailed description and to the accompanying sheets of drawings in which a preferred structural embodiment incorporated in the principals of the present invention, is shown by way of illustrative example.

Specifically, the present invention includes a manually rotatable disc on which are affixed one or more electromagnetic pick-up heads. The rotatable disc is fixedly attached to a central shaft which in turn is rotatably mounted within a hollow cylinder. The hollow cylinder, shaft and rotatable disc are all mounted within the body of the electric guitar with the rotatable disc being substantially coplanar to the face of the guitar. When rotation of the electromagnetic pick-up heads is desired, the user may simply rotate the rotatable disc by applying finger pressure to the face of the rotatable disc, thereby causing the desired degree of rotation of the pickup heads. The frictional force existing between the central shaft and the bushing on which the central shaft is mounted retards rotation of the rotatable disc and causes the disc and the electromagnetic pick-up heads to quickly stop in a desired position.

The problem of maintaining electrical contact between the pick-up head and the amplifier is solved by having a wire extend from the pick-up head through a central aperture in the cylinder to the electrical connector on the guitar. Alternatively, a movable electrical contact may be provided which remains against a second fixed electrical contact during rotation of the disc.

It has been found that the present invention allows reversal of the pick-up heads, or movement to a variety of positions which alters the sound produced by the guitar in a highly desirable way.

BRIEF DESCRIPTION OF THE DRAWINGS

FIG. 5 of the drawings is a top view of the cylinder used for mounting the rotatable disc of FIG. 3.

FIG. 6 of the drawings is a side cut away view of an alternate embodiment of the rotatable pick up head of FIG. 2.

FIG. 7 of the drawings is a side cut away view of an alternate embodiment of the rotatable pick up head of FIG. 2.

DETAILED DESCRIPTION OF THE PREFERRED EMBODIMENT

Figure 1:
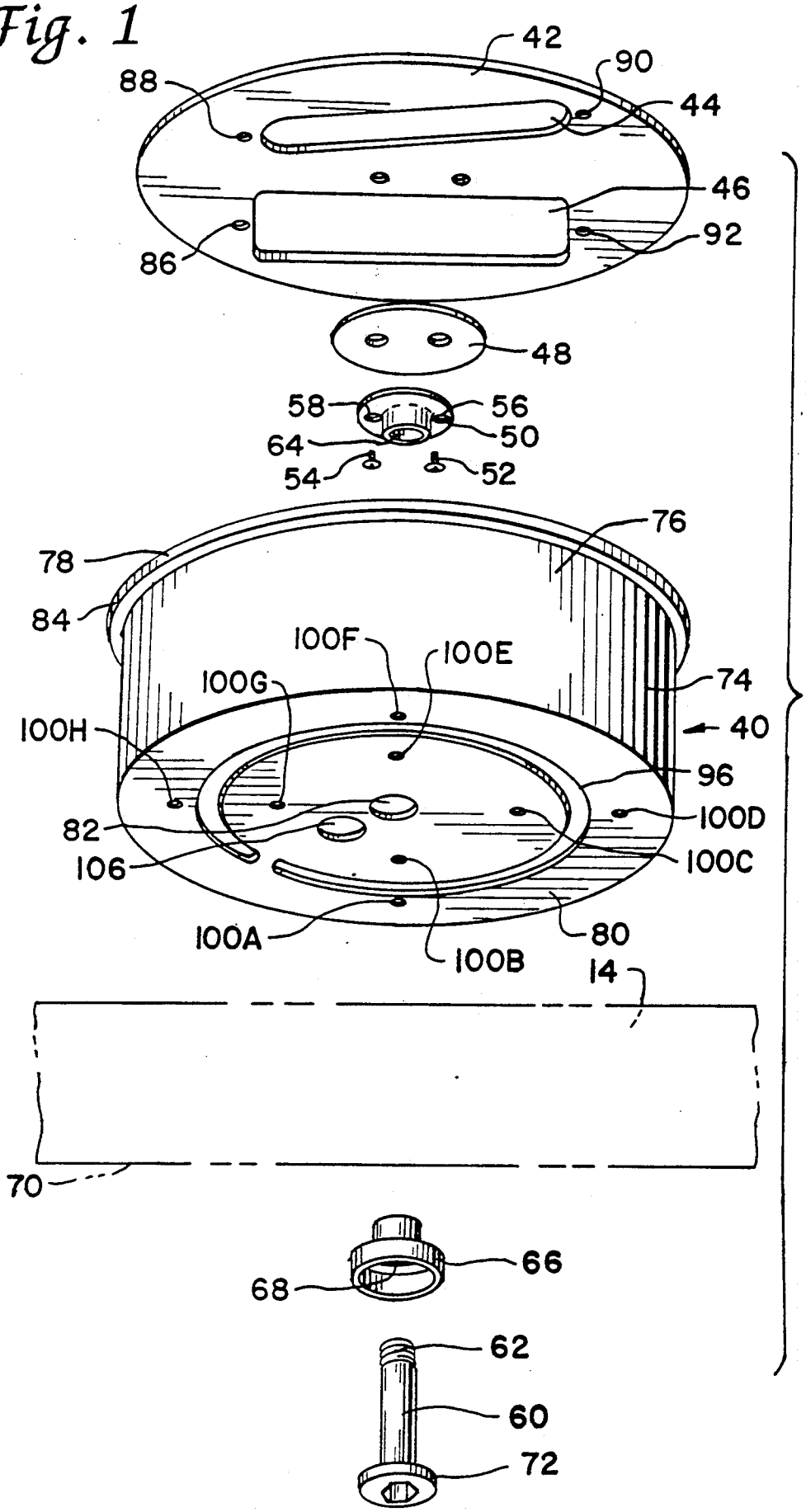
FIG. 1 of the drawings is a front view, partially broken way. of an electrical guitar incorporating the rotatable pick-up head of the present invention.

As best shown in FIG. 1 of the drawings, a guitar 10 is shown having a neck 12, a body 14 and strings 16*a–f*. Strings 16*a–f* are attached at a first end to the head (not shown) of the guitar, and in the embodiment shown at their second end to a tremolo device 18. Alternatively, a conventional mounting of the end of the strings may be utilized. A guitar 10 includes a volume control 18, a tone control 20 and pick-up heads 22, 24 and 26. In the embodiment shown, pick-up head 22 is designed to pick-up the vibrations of the strings near the head of the guitar. Pick-up head 24 is designed to pick-up vibrations of the strings in the middle of the instrument, and pick-up head 26 is designed to pick-up vibrations of the string near the bridge or tremolo 18.

In the embodiment shown, three output switches 28, 30 and 32 are provided. Output switch 28 controls output of the neck pick-up head 22. Output switch 30 controls output of the middle pick-up head 24. Output switch 32 controls output of the bridge pick-up head 26. The electrical output from the subpick-up heads is carried by conventional wires as will be described herein to electrical connectors 34, 36 and 38 respectively, for output to one or more amplifiers.

Figure 2:
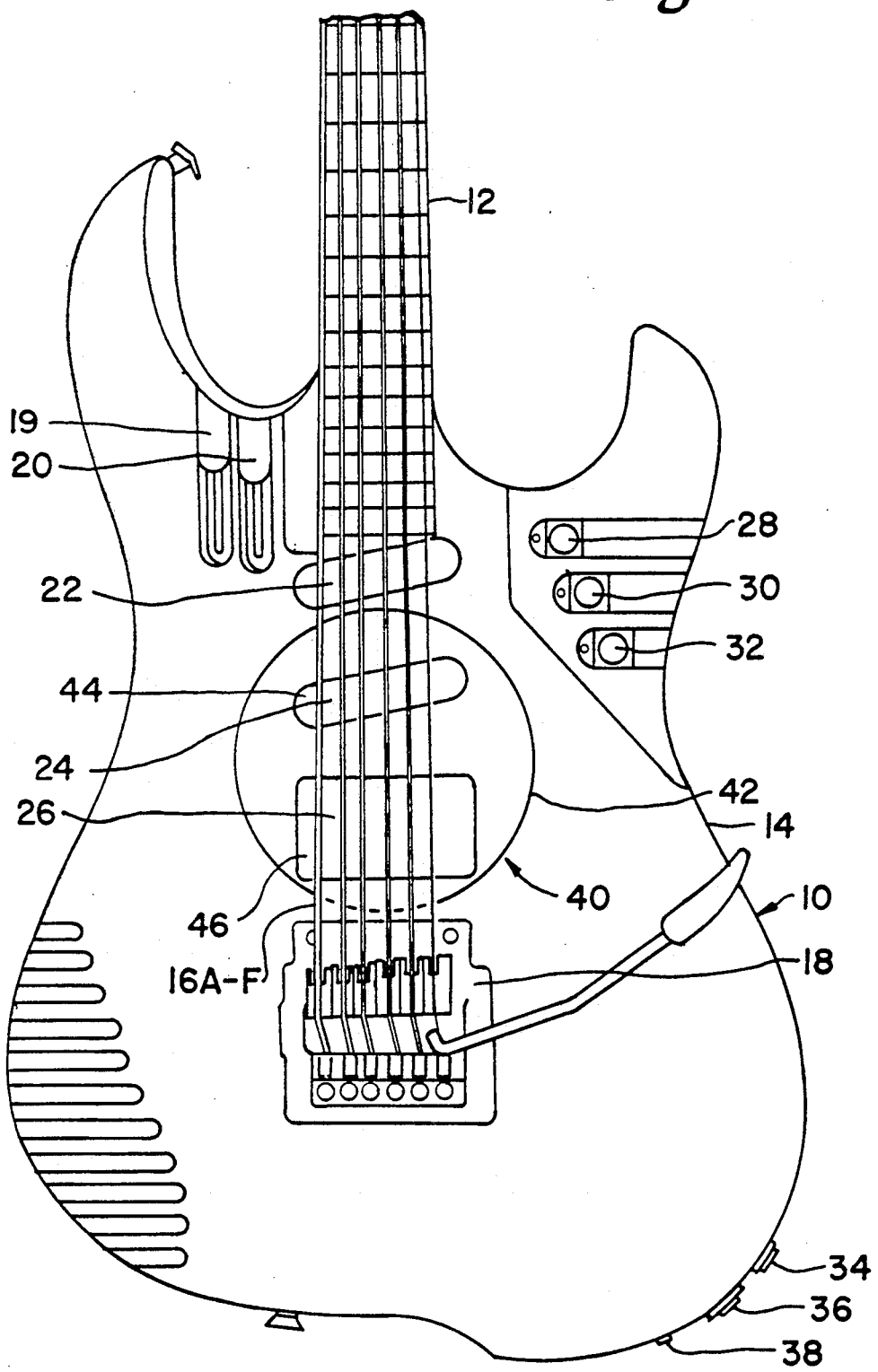
FIG. 2 of the drawings is an exploded view of the rotatable pick-up head of the electric guitar of FIG. 1.
Figure 3:
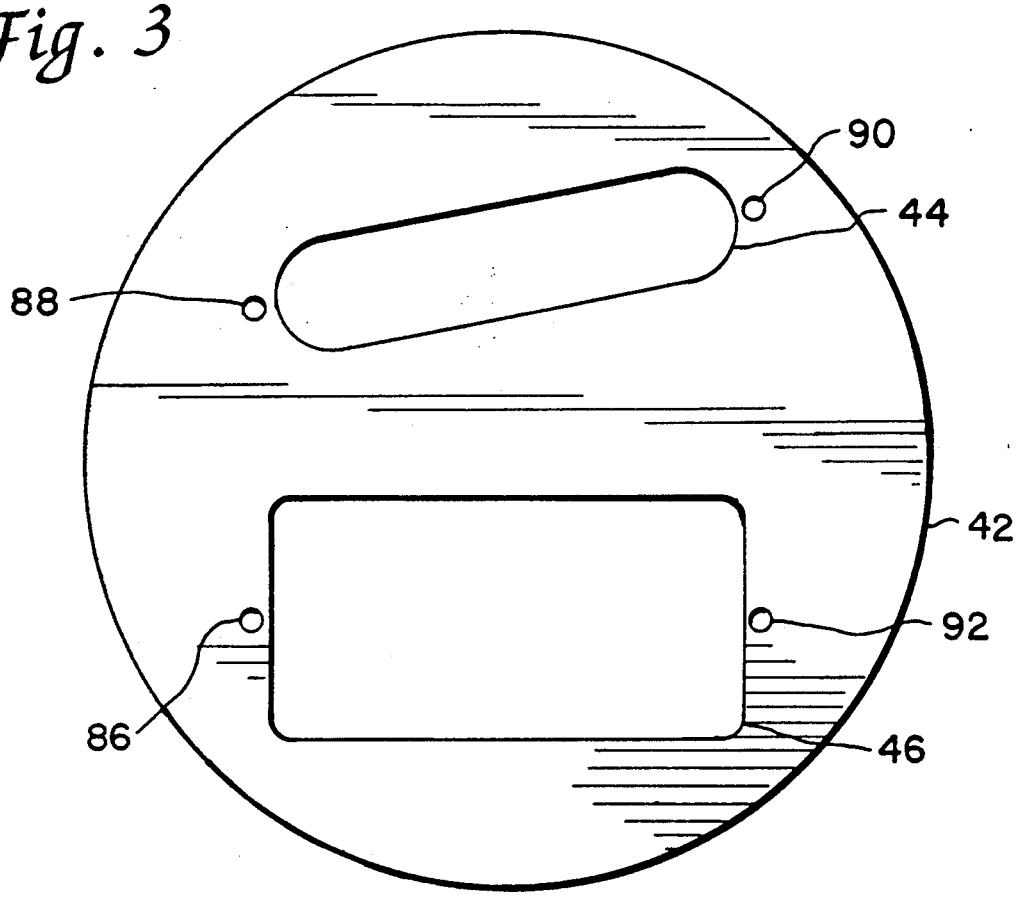
FIG. 3 of the drawings is a top view of the rotatable disc of the rotatable pick-up head of FIG. 1.

As shown in FIGS. 1 through 3, a manually rotatable electromagnetic pick-up device 40 is provided for sensing the vibrations of musical instrument 10. Device 40 includes a manually rotatable disc 42, best shown in FIG. 2. Rotatable disc 42 includes a pair of slots 44 and 46. Electromagnetic pick-up heads 24 and 26 are mounted therein. Slots 44 and 46 are sized for conformity to the outside dimensions of pick-up heads 24 and 26, and for supporting pick-up heads 24 and 26 therein.

Rotatable disc 42 has a washer 48 abutting against it and centrally disposed thereon. A holding nut 50 in turn abuts against washer 48. A pair of screws 52 and 54 extend through apertures 56 and 58, and fixedly retain holding nut 50 on rotatable disc 42. A shaft 60 extends through the body 14 of guitar 10. Shaft 60 has a threaded end 62 which is sized and threaded for mating engagement with a corresponded threaded receptacle 64 in holding nut 50. A bushing 66 and a central aperture 68 extending therethrough is fixedly positioned on the bottom 70 of guitar body 14. Shaft 60 extends through central aperture 68 with the head 72 of the shaft 60 rotatably mounted in bushing 66.

As further seen in FIGS. 2 and 3, a cylinder 74 is provided, having a hollow interior 76, an open top end 78 and a substantially closed bottom end 80. Shaft 60 extends through a central aperture 82 in cylinder 74, so as to support rotatable disc 42 thereon. In the embodiment shown, rotatable disc 42 is supported on its edges by ledge 84. In addition to providing support, ledge 84 serves as a break for retarding the rotation of rotatable disc 42, so as to allow rotatable disc 42 to be manually rotated to selected positions. At the same time, rotatable disc 42 is sufficiently supported by central shaft 60 to allow easy rotation. Rim 98 surrounds ledge 84.

Figure 4:
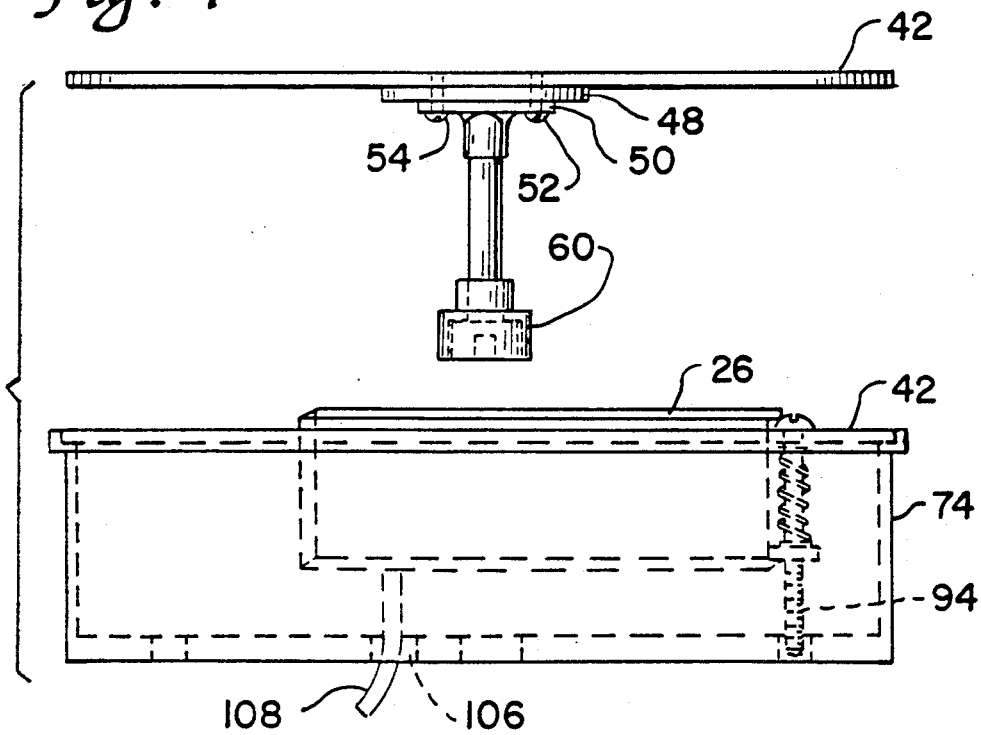
FIG. 4 of the drawings is a side cut-away view of the rotatable pick-up head of FIG. 1 of the drawings.

Turning to FIG. 1, it may be seen that pick-up heads 24 and 26 are fixedly mounted on rotatable disc 42. As is shown in FIG. 3, rotatable disc 42 has pairs of apertures 86, 88, 90 and 92 provided for reception of screws (not shown) which extend through the apertures and into appropriate receiving apertures on the pick-up heads 24 and 26. However, as shown in FIG. 4, one of the screws 94 is sized to extend below pick-up head 24 into a semicircular slot 96, also seen in FIG. 5. Screw 94 when retained in slot 96 serves as a guide to provide smooth rotation of rotatable disc when desired.

As further seen in FIG. 5, a plurality of mounting apertures 100*a–h* is provided for mounting cylinder 74 within the body 14 of guitar 10. The cylinder 74 is fixedly positioned therein.

As described above, rotation of rotatable disc 42 may be manually accomplished in a variety of selected positions. As for retaining disc 42 in a desired position, that may be accomplished by the friction provided by bushing 66, by the friction against ledge 84, or, as shown in FIG. 7, by a plurality of slots such as slot 102 provided in disc 42, which may be engaged against one or more flexible stops 104. A plurality of these slots and stops may be provided to control rotation of rotatable disc 42 to a plurality of selected positions.

As seen in FIG. 2, an aperture 106, offset from the bottom surface 80 of cylinder 74 can be provided to allow passage of wires 108 and 110, which extend respectively to pick-up heads 24 and 26. It should be noted in this regard that in the embodiment shown, bottom surface 80 has a substantially circular slot 96 extending therethrough, which is interrupted by a land portion 108, which supports the middle of the bottom surface of the cylinder. This land portion 108 prevents the 350° rotation of the rotatable disc 42, thereby preventing excessive twisting of the wires 108 and 110. Alternatively, as shown in FIG. 6, an electrical contact 112, may extend downwardly from pick-up heads 24, 26, to come into contact with a second electrical contact 114. Contact 114 extends in a substantially circular arc from the bottom surface 80 of cylinder 76. As a result, electrical contact between pick-up head 24 and amplifier 116, is maintained. Alternatively, electrical contact 112 may extend against the corresponding second contact 114, which is mounted on shaft 60. Second electrical contact 114 must be electrically isolated from shaft 60, and a wire extend through shaft 62 to electrical connector 36.

As described above, device 40 is a mounting bracket adaptable to any new guitar, and suitable for addition to a used guitar as a supplement. The main feature of device 40 is its manually turnable design. Rotatable disc 42 may be rotated up to 350° by hand. By turning disc 42 with pick-ups 24 and 26 affixed thereon, almost unlimited sound effects and sound combinations may be achieved.

An additional feature of the invention is the size of rotatable disc 42. As seen in FIG. 1, rotatable disc 42 is a diameter substantially greater than the distance from the first string 16*a* to the last string 16*f*. As a result, a musician while playing guitar 10, may extend either a finger or thumb and digitally rotate rotatable disc 42 with desired number of degrees. This rotation is accomplished easily and quickly and without the use of any other mechanical or electrical aids. In addition, the mounting of rotatable disc 42 prevents buzzing or distortion of the sound picked up by the pick-up heads 22–26.

EXAMPLE I

The most simple possibility is to exchange the positions of pick-ups 24 and 26 shown in FIG. 1.

It is standard practice for an electrical guitarist to install a "humbucker" at the rear position 26 for a rocky sound. On the other hand, a very clean sharp sound may be achieved by a single coil at the rear position 26. In order to utilize the respective advantages of a "humbucker" or a single coil, two separate guitarist were necessary in the past. The present device makes it possible to use "humbuckers" and single coils on just one guitar by simply turning the disc.

EXAMPLE II

If the output of pick-up heads 24 and 26 are individually connected to separate amplifiers, as through electrical connectors 36 and 38, and rotatable disc 42 is turned by approximately 90° clockwise, one can get a stereo panning effect which cannot be realized in any other way. The "humbuckers" 26, receive the base strings, and the single coil 24 receives the trouble strings. If the strings are now touched from low E to high E, the sound moves from left to right.

EXAMPLE III

When disc 42 is set to the same position as Example II (90° clockwise), pick-up head 26 is connected to a distortion device commonly known in the art. Pick-up head 24 is connected to a chorus, again commonly known in the art. As a result, the base strings sound distorted, and the treble strings sound clean with a chorus-like effect. Without turning the disc, a preset system is obtained, wherein pick-up head 22 picks up a clean sound, pick-up head 24 picks up a chorus, and pick-up head 26 picks up a distorted sound.

EXAMPLE IV

Rotatable disc 42 is rotated 90° counter clock wise. Output switches 28 and 30 are switched on. With this combination, a single coil base in an out-of-phase sound on the treble strings is produced.

In summary, the present device 42 opens a wide range of possibilities for musicians to create individual ways for providing music with a personal sound, which is not possible with a conventional guitar, or with the pick-up head devices disclosed in the background of the invention.

The foregoing description and drawings merely explain and illustrate the invention, and the invention is not limited thereto except insofar as those who have the disclosure before them are able to make modifications and variations therein without departing from the scope of the invention.

I claim as my invention:

1. A manually rotatable electromagnetic pickup device for sensing vibrations in a musical instrument, said device comprising:

a manually rotatable disc;

means for rotatably mounting said rotatable disc on said musical instrument;

means for selectively fixing the rotational position of said rotatable disc;

means for mounting one or more electromagnetic pickups on said rotatable disc;

means for electrically connecting said electromagnetic pickups to one or more amplifiers;

said means for rotatably mounting said rotatable disc on said musical instrument comprising a shaft member fixedly attached at a first end two said rotatable disc and rotatably attached to the second end to said musical instrument;

a substantially circular groove on said bottom portion of said cylinder means for supporting the central portion within said substantially circular groove; and a guide member extending from said rotatable disc into said circular groove so as to guide the rotation of said disc.

2. The manually rotatable electromagnetic pickup device of claim 1 and further comprising:

guide means for guiding the rotation of said manually rotatable disc through an arc of approximately 350°.

3. The manually rotatable pickup device of claim 1, wherein said means for selectively fixing the rotational position of said rotatable disc comprises:

means on said shaft member for frictional engagement with said bushing member so as to retard the rotational movement of said shaft.

4. The manually rotatable electromagnetic pickup device of claim 1, wherein said means for selectively fixing the rotational position of said rotatable disc comprises:

brake means for exerting a frictional force on said rotatable disc so as to retard the rotation thereof.

5. The device of claim 2, wherein said guide means comprises:

a substantially circular groove disposed on said bottom portion of said cylinder means for supporting the central portion of said bottom portion within said substantially circular groove; and a guide member extending from said rotatable disc into said circular groove so as to guide the rotation of said disc.

6. The device of claim 5, wherein means for mounting said electronic pickup heads includes a plurality of mounting screws and a plurality of screw apertures and said guide member comprises one of said mounting screws extending from one of said screw apertures and into said circular groove so as to guide the rotation of said rotatable disc.

7. The device of claim 1, wherein said means for electrically connecting said electromagnetic pickups to an amplifier comprises:

an electrical connector on said musical instrument;

one or more wires extending from said electromagnetic pickup heads through said centrally disposed aperture to said electrical connector, said wires being rotatable in said aperture; and a wire running from said electrical connector to said amplifier.

8. The device of claim 1, wherein said means for electrically connecting said electromagnetic pickup to an amplifier comprises:

an first electrical contact member extending from said rotatable disc; and a second electrical contact member mounted on said cylinder member and in contact with said first electrical contact member;

said first and second contact members being constructed and arranged to remain in contact during rotation of said rotatable disc.

9. The device of claim 8, wherein said second electrical contact comprises a substantial circular track insulated from said cylinder and electrically connected to said amplifier.

10. The manually rotatable pickup device of claim 1, wherein said means for selectively fixing the rotational position of said rotatable disc comprises a ledge circumferentially disposed about the periphery of said cylinder, said ledge being sized and positioned for slidably supporting said rotatable disc.

11. An electric guitar comprising:

a guitar body;

a plurality of strings mounted on said guitar body;

a manually rotatable disc having one or more electromagnetic pickup heads mounted thereon so as to allow movement of said pickup heads to a plurality of desired positions;

means for rotatably mounting said rotatable disc on said electric guitar;

means for selectively fixing the rotational position of said rotatable disc in each of said desired positions;

means for electrically connecting said electromagnetic pickup heads to an amplifier;

a cylinder member having an open top portion and a substantially closed bottom portion with a centrally disposed aperture extending therethrough; and a shaft member extending through said central aperture, said rotatable disc being mounted proximate said strings and said electromagnetic pickup heads being mounted within said cylinder, said cylinder being mounted within the body of said guitar.

12. The electric guitar of claim 11, and comprising guide means for guiding the rotation of said manually rotatable disc through are of approximately 350°.

13. The electric guitar of claim 11, and further comprising a bushing member mounted in said central aperture with said shaft member being rotatably mounted thereon and extending therethrough; and means on said shaft member for frictional engagement with said bushing member so as to retard the rotational movement of said shaft.

14. The electric guitar of claim 11, and further comprising:

a substantially circular groove disposed on said bottom portion of said cylinder and a guide member extending from said rotatable disc into said circular groove so as to guide the rotation of said disc; and means for supporting the central portion of said bottom portion within said substantially circular groove.

15. The electric guitar of claim 11, wherein said manually rotatable disc is centrally disposed on said guitar and is positioned beneath said strings for easy digital engagement and rotation by the player of the guitar during use thereof.

16. The electric guitar of claim 11, wherein a portion of the top surface of said rotatable disc extends laterally from beneath said strings when mounted on said guitar whereby said rotatable disc may be rotated by the user placing a finger on said portion of the top surface of said rotatable disc and spinning said rotatable disc to another position.

* * * * *